US005821840A

United States Patent [19]

Ricker

[11] Patent Number: 5,821,840

[45] Date of Patent: Oct. 13, 1998

[54] SIMPLIFIED SOLENOID ASSEMBLY

[75] Inventor: Russell D. Ricker, Chichester, N.H.

[73] Assignee: WPI Magnetec, Inc., Warner, N.H.

[21] Appl. No.: 886,437

[22] Filed: Jul. 2, 1997

Related U.S. Application Data

[60] Provisional application No. 60/041,337 Mar. 20, 1997.

[51] Int. Cl. [6] ..... H01H 67/02

[52] U.S. Cl. ..... 335/128; 335/250; 335/251; 335/78

[58] Field of Search ..... 335/78–86, 124, 335/128, 129, 131, 133–5, 126, 167–76, 239–45, 23–25, 250–5

[56] References Cited

U.S. PATENT DOCUMENTS

| | | | |
|---|---|---|---|
| 2,975,252 | 3/1961 | Juptner | 335/85 |
| 4,553,116 | 11/1985 | Bagalini | 335/20 |
| 4,864,262 | 9/1989 | Deb | 335/20 |
| 5,075,660 | 12/1991 | Ootsuka | 335/78 |

*Primary Examiner*—Lincoln Donovan
*Attorney, Agent, or Firm*—Daniel J. Bourque, Esq.; Kevin J. Carroll, Esq.

[57] ABSTRACT

A simplified solenoid assembly has a simplified construction that maintains the mechanical integrity and operating efficiency of the solenoid. The solenoid assembly includes a frame having first and second frame leg portions extending from a frame middle portion. The side region of the first frame leg portion includes an aperture, and the side region of the second frame leg portion defines a frame pole face generally opposite the aperture. A bobbin having first and second bobbin end portions and a generally cylindrical bobbin intermediate portion is "snap-fit" between the frame leg portions. A plunger receiving region formed in the bobbin is aligned with the aperture through the frame, and the second bobbin end portion extends across the plunger receiving region to form a fixed gap between the bobbin and the frame. A plunger is slidably received through the aperture in the frame and into the plunger receiving region within the bobbin.

27 Claims, 6 Drawing Sheets

20

SIMPLIFIED SOLENOID ASSEMBLY

RELATED APPLICATION

This application claims the benefit of U.S. Provisional patent application Ser. No. 60/041,337 filed on Mar. 20, 1997.

FIELD OF THE INVENTION

The present invention relates to solenoid assemblies and in particular, to a solenoid assembly having simplified construction and simplified assembly into higher level systems.

BACKGROUND OF THE INVENTION

Solenoids are often critical components in higher level electronic and mechanical systems or devices, for example, to provide electromechanical actuation. Ongoing efforts at reducing the costs of electronic and mechanical systems have resulted in a need for manufacturing solenoids at a lower cost without affecting the operation of the solenoid and the higher level system. Conventional solenoids typically include a number of individual parts necessary for efficient operation of the solenoid, for proper assembly of the solenoid, and for physical and electrical connection of the solenoid within the higher level system. A need exists for a solenoid having fewer parts and requiring fewer manufacturing steps.

One type of solenoid 10, FIG. 1, includes a bobbin 12 made of a dielectric material within a frame 19. A wire 14 wound around the bobbin 12 forms a winding that generates a magnetic field when electric current is provided through the wire 14. The bobbin 12 has an aperture that slidably receives a plunger 16 such that the magnetic field generated by the winding forces the plunger 16 to slide within the aperture.

In previous solenoid designs of this type, a stop 18 made of metal was required to properly secure the bobbin 12 within the frame 19 and to ensure proper operation of the solenoid. During manufacturing, the stop 18 must be press fit through an aperture in the frame 19 and into the aperture of the bobbin 12 to physically secure the bobbin to the frame 19. According to accepted solenoid theory, the stop 18 will also typically prevent leakage of magnetic flux during the operation of the solenoid 10 to assure efficient operation of the solenoid. Elimination of the stop 18 in this solenoid design has previously been considered impossible because of the loss in electromagnetic efficiency as well as the required mechanical connection.

Use of the stop 18 in solenoid designs has added considerably to the manufacturing time and cost of the solenoid assembly. In addition to requiring an extra part, the frame 19 must be formed with an additional aperture to receive the stop 18. Moreover, assembly of the solenoid requires the additional steps of providing a stop, and press fitting the stop 18, with press equipment, through the aperture in the frame 19 and into the aperture in the bobbin 12.

A further drawback of conventional solenoid designs is the way in which the solenoid must be mechanically and electrically connected in the higher level system. According to one type of solenoid design, the bobbin 12 includes metal pins 13 extending from the bobbin 12 to provide a connection to terminals in a higher level system such as a printed circuit board. After winding the wire 14 around the bobbin, the loose ends of the wire are wound around the metal pins 13 and soldered to the pins 13. This design requires additional manufacturing steps and costs in securing the metal pins 13 to the bobbin 12, soldering the loose ends of the wire 14 to the metal pins 13 and cleaning the flux used in the soldering process from the solenoid.

According to another design (not shown), the wire is wound around the bobbin to form the winding, and the winding is then wrapped, e.g. with tape, to prevent the winding from unwinding. Insulated lead wires are then soldered to the winding to provide an electrical connection to terminals in the higher level system. This type of design involves the added steps and costs involved in securing the winding and soldering the lead wires to the winding.

Accordingly, a need exists for a solenoid assembly having a simplified and less expensive construction and manufacturing process while maintaining or improving plunger movement response time and the efficiency of the solenoid. In particular, a need exists for a solenoid assembly that eliminates the stop and simplifies the electrical connection to terminals in the higher level systems.

SUMMARY OF THE INVENTION

The present invention features a solenoid assembly comprising a frame, a coil assembly including a bobbin, and a plunger. An aperture extends through a first side region of the frame, and a second side region of the frame defines a frame pole face generally opposite the aperture through the first side region. The coil assembly is adapted to be received in the frame between the at least first and the second side regions, and the bobbin has at least one frame locking member, for locking with a locking region of the frame.

The bobbin also defines a plunger receiving region adapted to be aligned with the aperture in the frame when the coil assembly is received in the frame. The plunger is adapted to be slideably received through the aperture of the frame and within the plunger receiving region of the bobbin. The plunger includes a plunger pole face adapted to face the frame pole face on the second side region of the frame when the plunger is slideably received through the aperture of the frame.

The preferred embodiment of the frame includes first and second frame leg portions extending from a frame middle portion, forming a generally C-shaped frame, although this is not a limitation of the present invention. The first and second side regions are formed on the respective first and second frame leg portions. A neck portion extends from the first frame leg portion to form a partially rounded internal region on the first side region defining the aperture through the first frame leg portion. At least one of the first and second side regions of the frame includes at least one notch, for engaging with the frame locking member of the bobbin.

The preferred embodiment of the bobbin includes first and second bobbin end portions, for engaging respective first and second side regions of the frame, and a bobbin intermediate portion extending between the first and second bobbin end portions and preferably having a generally cylindrical shape. The first and second bobbin end portions and the bobbin intermediate portion are preferably formed as one piece from a dielectric material. The frame locking member is disposed on at least one of the first and second bobbin end portions and preferably includes a ramped surface, for sliding into locking engagement with the locking region of the frame. The plunger receiving region extends through the first end portion of the bobbin and into the bobbin intermediate portion.

According to one preferred embodiment of the bobbin, the second bobbin end portion extends across the plunger receiving region, for forming a fixed gap between the plunger and the second side region of the frame when assembled. The fixed gap formed by the bobbin end portion prevents residual magnetism in the plunger and frame from causing the plunger to stick.

According to another preferred embodiment of the bobbin, at least one of the first and second end portions of the bobbin includes at least one wire anchor member extending from and one-piece with the end portion, for anchoring loose ends of the wire. The wire anchor members provide a simplified electrical connection to terminals in a higher level assembly.

The preferred embodiment of the plunger includes a body portion having a generally cylindrical shape and a pole face having a generally truncated cone shape. The generally truncated cone shape preferably has a taper of about 17°.

When assembled, the solenoid of the present invention does not require a stop secured between the frame and the bobbin. The magnetic flux flows from the pole face on the plunger across to the pole face on the second side region of the frame. The configuration of the frame pole face on the second side region of the frame and the plunger pole face on the plunger maximize the flow of flux across the air gap. The geometry of the neck portion and the partially rounded internal region of the first side region increases the flux density within the plunger as a result of the magnetic flux flow from the partially rounded internal region of the first side region of the frame to the plunger. Accordingly, the assembled solenoid without a stop is simplified in construction and assembly while maintaining or improving the efficiency of the solenoid with the frame and plunger geometries.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
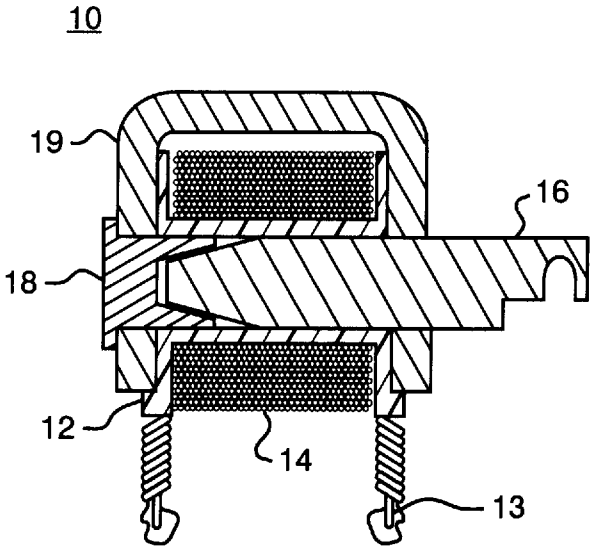
FIG. 1 (PRIOR ART)
FIG. 1 is a cross-sectional view of a prior art solenoid assembly having a stop and metal pin connectors.

A solenoid assembly 20, FIGS. 2A–2F, according to the present invention, includes a frame 22, a coil assembly having a bobbin 30 and a winding 40 around the bobbin 30, and a plunger 50 that moves within the bobbin 30. The assembled solenoid 20 is adapted to be mechanically and electrically connected within a higher level electronic or mechanical system. The solenoid 20, according to the exemplary embodiment of the present invention, preferably operates at a relatively high speed (e.g., less than 2 mS) and operates from battery power, such as a 5.8 VDC battery pack. The exemplary solenoid 20 is preferably used as an actuator in a higher level system, such as a camera, or other system in which a need exists for a low cost, relatively high speed solenoid. The present invention contemplates a solenoid having various operating characteristics (e.g. the speed and force at which the plunger 50 moves in the bobbin 30) and capable of being used in various types of systems or devices.

One feature of the solenoid assembly 20, according to the present invention, is the elimination of the stop previously used to secure the bobbin 30 to the frame 22. Instead, the bobbin 30, typically an injection molded single piece, includes one or more frame locking members 31*a*, 31*b* (FIGS. 2A, 2B and 2D) of which one embodiment is in the form of a generally "L" shaped ramped, raised region that engages with the frame 22, to provide a "snap-in" locking of the bobbin 30 between side regions of the frame 22, as will be described in greater detail below. Eliminating the stop, the press equipment and the pressing step needed to secure the stop simplifies and lowers the cost of the present solenoid assembly 20.

The preferred geometry of the solenoid 20 according to the present invention takes advantage of the radial leakage flux (or permeance lines) caused by eliminating the stop to improve the response time and overall efficiency of the solenoid. In conventional solenoids 10 (FIG. 1) having a stop 18, one purpose of the stop was to prevent leakage flux at the working air gap where the flux flows symmetrically across the air gap from the plunger 16 to the stop 18. However, it was discovered that the stop 18 has a negligible effect on the leakage flux in solenoids of smaller sizes, e.g., industry standard solenoid packages from an envelope of ¾ $in^3$ to ¼ $in^3$ and possibly up to the 1⅜ $in^3$ packages as well. When the stop is eliminated in the solenoid 20 of the present invention, the flux is directed across the air gap to the frame 22.

In light of these findings, the geometry of the frame 22 and plunger 50 according to the present invention optimizes the flow of magnetic flux between the plunger 50 and the frame 22. In a region 60 (FIG. 2F) where the plunger 50 is received, the geometry of the frame 22, as will be described in greater detail below, increases the flux density in the plunger 50. In a region 62 at the opposite end of the frame 22, the geometry of the plunger 50, as will be described in greater detail below, together with the frame 22, allows part of the leakage flux to be directed from the plunger 50 to the frame 22 and thereby maximizes flux transfer to the frame 22.

The frame 22 thereby forms a magnetic frame pole face 64 opposite a magnetic plunger pole face 54 on the plunger 50. Thus, in the solenoid 20 of the present invention, an axial force component on the plunger 50 is derived from the leakage flux that flows to the frame 22, and contrary to the accepted electromagnetic theory, the leakage of magnetic flux caused by eliminating the stop does not decrease efficiency of the solenoid.

Another feature of the solenoid 20 of the present invention is the fixed gap 34 (FIG. 2F) provided between the end of the plunger 50 and frame 22 to prevent residual magnetism in the plunger 50 and frame 22 from causing the plunger 50 to stick when de-energized. The fixed gap 34 is preferably formed from and by the dielectric material of the bobbin 30 extending partially or completely across one end of the bobbin opposite from the plunger receiving region 60 in the bobbin 30, and generally located where the prior art stop 18 (FIG. 1) was previously located. The magnetic flux flows from the plunger pole face 54 of the plunger 50 across the fixed gap 34 to the framed pole face 64 on the frame 22.

A further feature of the solenoid 20 of the present invention is a simplified electrical connection to terminals in a higher level assembly. The bobbin 30 itself includes wire anchor members 32*a*, 32*b* (FIGS. 2A, 2E and 2F) extending from and formed as one piece with the bobbin 30. The loose regions 42, 44 of the wire 40 approximately 1" to 6" in length from the ends of the wire 40 are wrapped around the wire anchor members 32*a*, 32*b*, preventing the wire 40 from unwinding and providing strain relief for the wire 40. The loose regions 42, 44 are preferably wrapped around the wire anchor members 32*a*, 32*b* leaving a flying lead of about 1 to 6 inches for electrical connection into the higher level system, for example, to terminals or other electrical contacts. By forming the wire anchor members 32*a*, 32*b* from the same dielectric material of the bobbin 30, the added steps of securing metal pins to the bobbin 30 and soldering are eliminated. In one example, the wire 40 is a 28-gauge wire made of extruded copper with a polyurethane insulating coating.

The present invention contemplates various types of solenoid assemblies having one or more of the above described features. The individual parts of the solenoid assembly according to the exemplary embodiment will be described in greater detail below. Although specific dimensions of the exemplary solenoid assembly are shown in the figures and described below, the present invention contemplates solenoid assemblies having various possible dimensions and/or shapes depending upon the desired application for the solenoid and the desired operating characteristics.

Figure 3A:
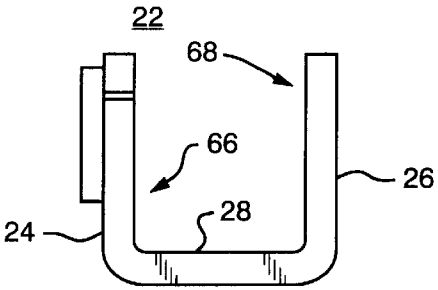
FIG. 3A is a side view of a first side of the frame used in the solenoid assembly according to the present invention.
Figure 3C:
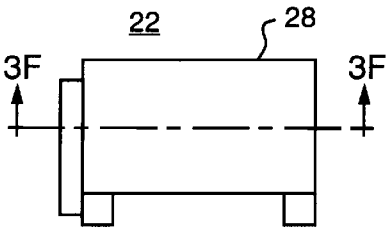
FIG. 3C is a top view of the frame used in the solenoid assembly according to the present invention.
Figure 3D:
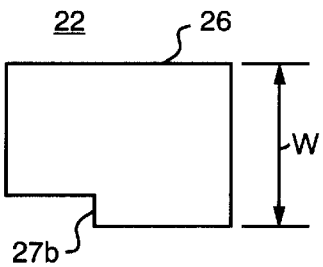
FIG. 3D is an end view of a second end of the frame used in the solenoid assembly according to the present invention.
Figure 3F:
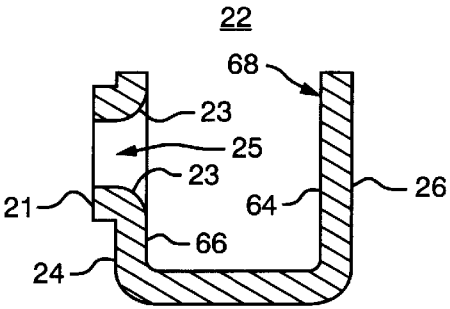
FIG. 3F is a cross-sectional view of the frame used in the solenoid assembly taken along line 3F—3F in FIG. 3C according to the present invention.
Figure 3E:
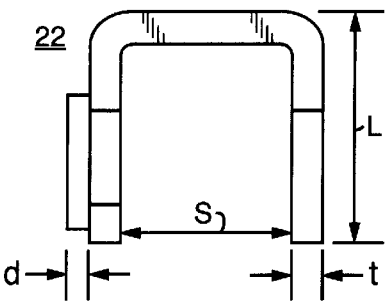
FIG. 3E is a side view of a second side of the frame used in the solenoid assembly according to the present invention.
Figure 3B:
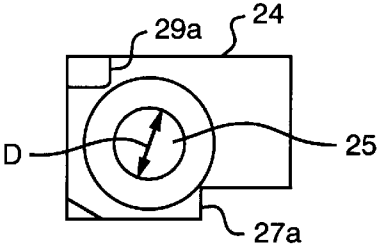
FIG. 3B is an end view of a first end of the frame used in the solenoid assembly according to the present invention.
Figure 4B:
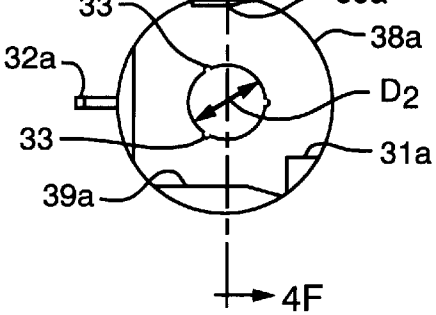
FIG. 4B is an end view of a first end of the bobbin used in the solenoid assembly according to the present invention.
Figure 4A:
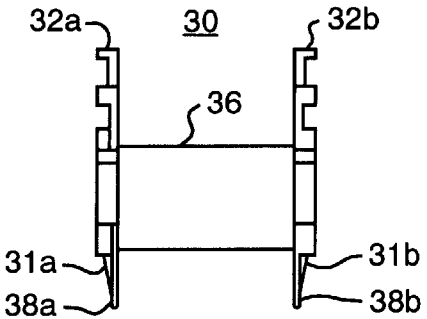
FIG. 4A is a side view of a first side of a bobbin used in the solenoid assembly according to the present invention.
Figure 4C:
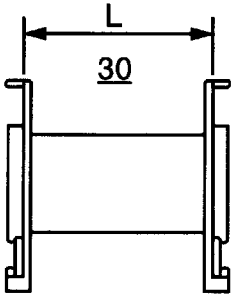
FIG. 4C is a top view of the bobbin used in the solenoid assembly according to the present invention.
Figure 4D:
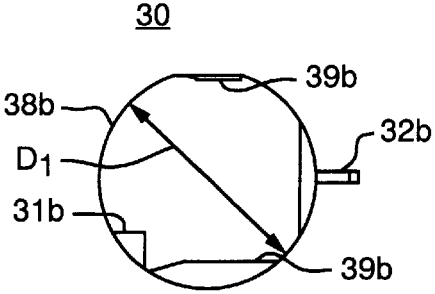
FIG. 4D is an end view of a second end of the bobbin used in the solenoid assembly according to the present invention.
Figure 4E:
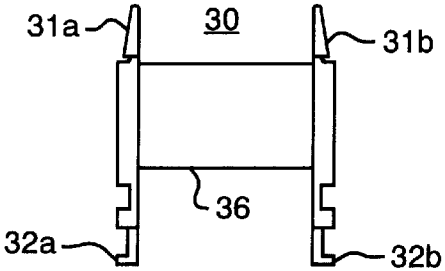
FIG. 4E is a side view of a second side of the bobbin used in the solenoid assembly according to the present invention.
Figure 4F:
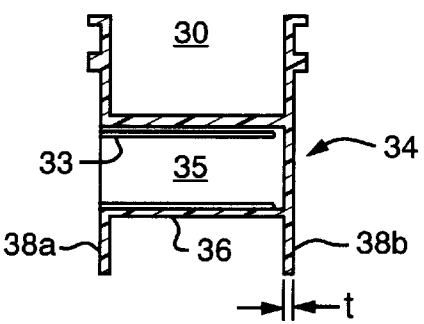
FIG. 4F is a cross-sectional view of the bobbin taken along line 4F—4F in FIG. 4B according to the present invention.
Figure 5D:
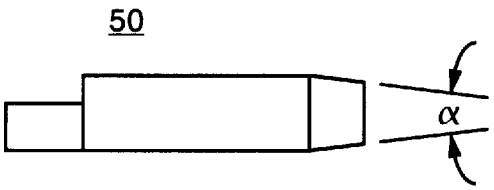
FIG. 5D is a bottom view of the plunger used in the solenoid assembly according to the present invention.
Figure 5E:
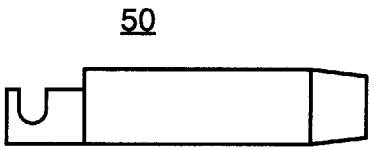
FIG. 5E is a side view of a second side of the plunger used in the solenoid assembly according to the present invention.
Figure 5F:
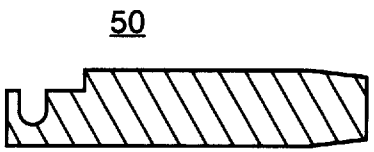
FIG. 5F is a cross-sectional view of the plunger taken along line 5F—5F in FIG. 5C according to the present invention.
Figure 5A:
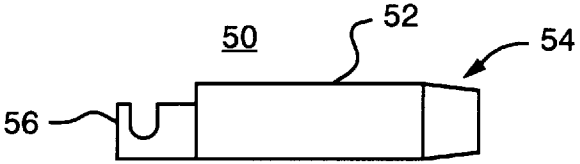
FIG. 5A is a side view of a first side of a plunger used in the solenoid assembly according to the present invention.
Figure 5B:
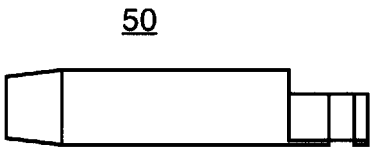
FIG. 5B is a top view of the plunger used in the solenoid assembly according to the present invention.
Figure 5C:
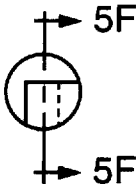
FIG. 5C is an end view of the plunger used in the solenoid assembly according to the present invention.

The frame 22, FIGS. 3A–3F, used in the solenoid assembly 20, according to the present invention, mechanically secures the solenoid assembly 20 in the system or device in which the solenoid is used. The frame 22 is preferably made of low carbon steel, such as AISI C1008, and has first and second frame leg portions 24, 26 extending from a frame middle portion 28 forming a generally C-shaped frame (FIG. 3A). The frame leg portions 24, 26 include respective frame side regions 66, 68 for receiving the bobbin 30.

Figure 2E:
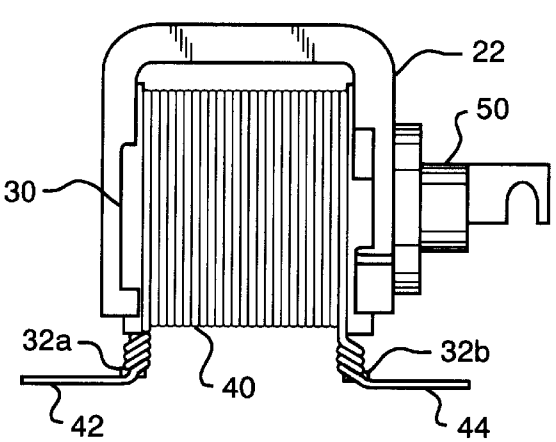
FIG. 2E is a side view of a second side of the solenoid assembly according to the present invention.
Figure 2D:
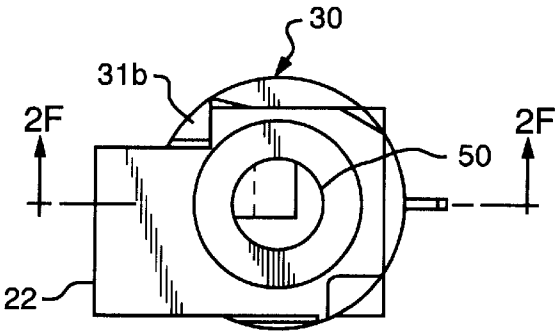
FIG. 2D is an end view of a second end of the solenoid assembly according to the present invention.
Figure 2C:
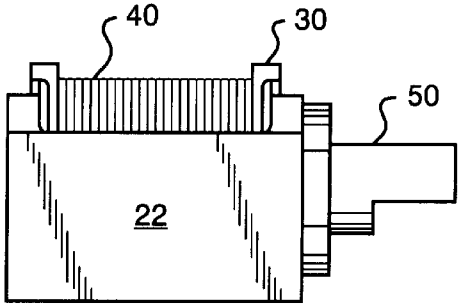
FIG. 2C is a top view of the solenoid assembly according to the present invention.
Figure 2A:
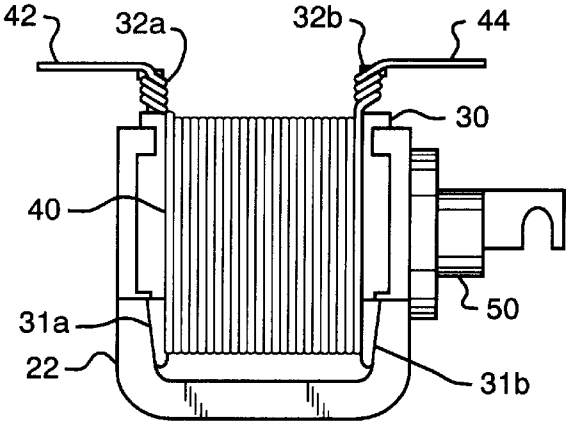
FIG. 2A is a side view of a first side of the solenoid assembly according to the present invention.
Figure 2B:
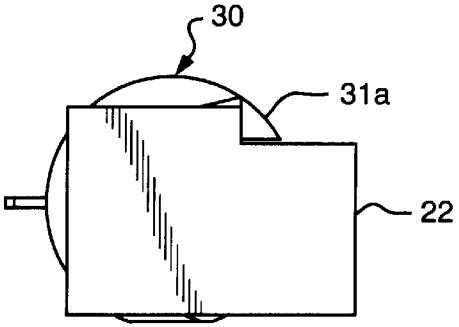
FIG. 2B is an end view of a first end of the solenoid assembly according to the present invention.
Figure 2F:
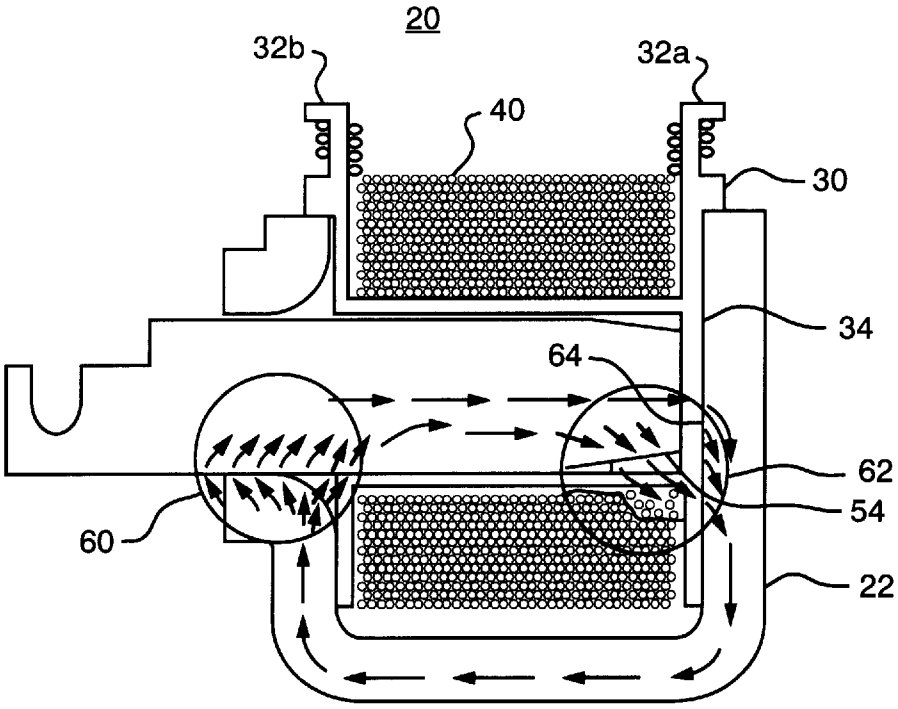
FIG. 2F is a cross-sectional schematic view of the solenoid assembly taken along line 2F—2F in FIG. 2D according to the present invention.

The first leg portion 24 includes an aperture 25 (FIGS. 3B and 3F) extending therethrough, for receiving the plunger 50 (FIG. 2F). The frame 22 preferably includes a journal or neck portion 21 formed by drawing the material of the frame 22 outwardly, creating a partially rounded or radiused internal region 23 in the frame side region 66 that defines the aperture 25 for the plunger. The geometry of the journal or neck portion 21 having the partially rounded internal region 23 at the aperture 25 allows the optimum flux density in the plunger 50, as described above.

The second frame leg portion 26 of the frame 20 preferably includes a generally planar side region 68. The frame pole face 64 is formed on the frame side region 68 generally opposite the aperture 25 through the first side region 66 of the first leg portion 24.

The frame 22 also includes one or more notches 27*a*, 27*b*, for mating with the frame locking members 31*a*, 31*b* on the bobbin 30 to provide the "snap-in" fit. The frame 22 can also include one or more additional notches 29*a*, 29*b* to engage with corresponding engaging members in the higher level system. One way of making the frame 22 is by using a progressive die to draw, stamp, and form the frame from a sheet of metal. Alternatively, the frame can be formed by sintering from powered metal, such as a 50—50 Ni/Fe composition.

In one example, the length l of the frame leg portions 24, 26 is about 0.66 inches; the width w of the frame leg portions 24, 26 is about 0.48 inches; the spacing s between the leg portions is about 0.505 inches; the diameter D of the aperture 25 is about 0.212 inches; the thickness t of frame leg portions 24, 26 and middle portion 28 is about 0.09 inches; and the neck portion 21 extends from the first leg portion 24 at a distance d of about 0.059 inches. These dimensions are one example of the dimensions of the frame 22 used in the solenoid assembly of the present invention and are not intended to be a limitation on the present invention.

The bobbin 30, FIGS. 4A–4F, used in the solenoid assembly 20 is made of a dielectric material, such as plastic, and preferably includes an intermediate portion 36 having a generally cylindrical shape with first and second bobbin end portions 38*a*, 38*b* on each end of the bobbin intermediate portion 36. The wire 40 is wound around the bobbin intermediate portion 36 between bobbin end portions 38*a*, 38*b*. A plunger receiving region 35 extends through one of the end portions 38*a* and into the intermediate portion 36, for receiving the plunger 50. The bobbin end portions 38*a*, 38*b* include the frame locking members 31*a*, 31*b* that engage with notches 27*a*, 27*b* on the respective frame leg portions 24, 26. At least one portion of the locking members 31*a*, 31*b* preferably has a sloped or tapered surface or "ramp" (FIG. 4E) that facilitates sliding of the bobbin end portions 38*a*, 38*b* between the frame leg portions 24, 26 until the frame locking members 31*a*, 31*b* are lockingly engaged with the respective notches 27*a*, 27*b* in the frame leg portions 24, 26 (FIGS. 2B and 2D).

The bobbin end portions 38*a*, 38*b* can also include one or more guide members 39*a*, 39*b* (FIGS. 4B and 4D) that engage the frame leg portions 24, 26 and align the bobbin 30 with the frame 22. The wire anchor members 32*a*, 32*b* are also formed on bobbin end portions 38*a*, 38*b*, for anchoring the loose ends 42, 44 of wire 40. One way of making the bobbin 30 is by injection molding the bobbin intermediate portion 36, end portions 38*a*, 38*b* and anchor members 32*a* 32*b* as one piece, although 2 or 3 piece constructions are also contemplated, as well as material other than plastic.

According to one preferred embodiment, the plunger receiving region 35 does not extend through the second bobbin end portion 38*b* such that the second bobbin end portion 38*b* forms the fixed gap 34 disposed between the end of the plunger 50 and the second frame leg portion 26. This fixed gap 34 formed from the dielectric material of the bobbin 30 prevents residual magnetism in the frame 22 and plunger 50 from causing the plunger 50 to stick when the solenoid is de-energized.

The plunger receiving region 35 also includes one or more flutes or channels 33 that allow air to be expelled from the plunger receiving region 35 when the plunger 50 slides into the plunger receiving region 35 and allows air to be received into the plunger receiving region 35 when the plunger slides out of the plunger receiving region 35. The flutes or channels 33 thereby prevent "dash-potting" or compression/suction that slows down movement of the plunger 50.

In one example, the bobbin 30 has a length l of about 0.5 inches; the end portions 38*a*, 38*b* have a thickness t of about 0.02 inches; the end portions 38*a*, 38*b* have a diameter $D_1$ of about 0.585 inches; the plunger receiving region 35 has a diameter $D_2$ of about 0.206 inches; and the wire anchor members 32*a*, 32*b* extend about 0.1 inch from the bobbin end portions 38*a*, 38*b*. The bobbin 30 is thereby dimensioned to snap-fit between the frame leg portions 24, 26 of the frame 22. These dimensions are merely one example of the bobbin made according to the present invention and are not intended to limit the present invention.

The plunger 50, FIGS. 5A–5F, used in the solenoid assembly 20 of the present invention, preferably has a generally cylindrical body portion 52 and the pole face 54 preferably has the shape of a truncated cone. This tapered design of the pole face 54 of the plunger 50 directs a portion of the leakage flux across the fixed gap 34 to the pole face 64 on the frame 22, thereby maximizing the flux transfer from the plunger 50 to the frame 22 (FIG. 2F). In the exemplary embodiment, the pole face 54 has a taper angle $\alpha$ of approximately 17° to provide optimum operating characteristics, e.g. the force and speed of the solenoid. The present invention contemplates other taper angles and other pole face geometries depending upon the particular application for the solenoid and the desired operating characteristics. At the other end of the generally cylindrical body portion 52, the plunger 50 includes an engaging portion 56 that engages the device to be actuated. The plunger 50 is preferably made of low carbon steel, such as AISI C12L14, for example, by turning on a lathe or CNC equipment, or by sintering from a powdered metal.

The method of assembling the solenoid 20 includes winding the wire 40 around the bobbin 30 and wrapping the loose ends 42, 44 of the wire 40 around the wire anchoring members 32*a*, 32*b*. One end 42 can be wrapped around one anchoring member 32*a* prior to winding or both ends 42, 44 can be wrapped after winding. Next, the bobbin 30 with the winding 40 (or coil assembly) is snapped in place within the frame 22. Finally, the plunger 50 is inserted into the bobbin 30. The assembled solenoid 20 is then ready to be shipped for assembly into a higher level system.

Accordingly, the solenoid assembly of the present invention has a simplified and lower cost construction and manufacturing process without sacrificing the force and speed requirements of the solenoid. The solenoid assembly eliminates the need for the stop used in conventional solenoids by providing a bobbin that snap fits within the frame. Eliminating the stop simplifies construction, and the geometry of the frame and plunger increase flux density in the plunger and direct magnetic flux from the plunger pole face to the frame pole face to maintain or improve plunger movement response time. The solenoid assembly also eliminates problems with residual magnetism by extending the dielectric material of the bobbin between the plunger and the frame.

Modifications and substitutions by one of ordinary skill in the art are considered to be within the scope of the present invention which is not to be limited except by the claims which follow.

What is claimed is:

1. A solenoid assembly comprising:

a frame including at least first and second side regions, wherein said first side region includes an aperture extending through said first side region, and wherein said second side portion of said frame defines a frame pole face generally opposite said aperture through said first side region;

a coil assembly adapted to be received in said frame between said at least first and second side regions, said coil assembly including a bobbin having at least one frame locking member, for at least releasably locking with said frame, wherein said bobbin defines a plunger receiving region adapted to be aligned with said aperture in said frame when said coil assembly is received in said frame; and a plunger adapted to be slidably received through said aperture of said frame and within said plunger receiving region of said bobbin, wherein said plunger includes a plunger pole face adapted to confrontingly align with said frame pole face on said second side region of said frame when said plunger is slidably received through said aperture of said frame.

2. The solenoid assembly of claim 1 wherein said first side region of said frame includes a partially rounded internal region defining said aperture through said first side region.

3. The solenoid assembly of claim 1 wherein said frame includes first and second frame leg portions extending from a frame middle portion, wherein said first and second side regions of said frame are formed on respective said first and second frame leg portions, and wherein said first frame leg portion includes said aperture extending therethrough.

4. The solenoid assembly of claim 3 wherein said frame includes a neck portion drawn out from said first frame leg portion to form a partially rounded internal region defining said aperture through said first frame leg portion.

5. The solenoid assembly of claim 1 wherein at least one of said first and second side regions of said frame includes at least one notch, for engaging with said at least one frame locking member of said bobbin.

6. The solenoid assembly of claim 1 wherein said bobbin includes first and second bobbin end portions, for engaging respective said first and second side regions of said frame, and wherein said bobbin includes a bobbin intermediate portion extending between said first and second bobbin end portions and having a generally cylindrical shape, and wherein said plunger receiving region extends through said first end portion of said bobbin and into said bobbin intermediate portion.

7. The solenoid assembly of claim 6 wherein said second bobbin end portion of said bobbin extends across said plunger receiving region, for forming a fixed gap between said plunger and said second side region of said frame when assembled.

8. The solenoid assembly of claim 6 wherein said at least one frame locking member is disposed on at least one of said first and second bobbin end portions of said bobbin, and wherein said at least one frame locking member includes a ramped surface, for sliding into locking engagement with said frame.

9. The solenoid assembly of claim 6 wherein said coil assembly includes a wire coiled around said intermediate portion of said bobbin, and wherein at least one of said first and second end portions of said bobbin includes at least one wire anchor member extending from and one-piece with said at least one of said first and second end portions, for anchoring loose ends of said wire.

10. The solenoid assembly of claim 1 wherein said plunger includes body portion having a generally cylindrical shape, and wherein said plunger pole face has a generally truncated cone shape.

11. The solenoid assembly of claim 10 wherein said generally truncated cone shape of said plunger pole face has a taper of about 17°.

12. A frame for use in a solenoid assembly, said frame comprising:

at least first and second frame leg portions extending from a frame middle portion and forming a generally C-shape, said first and second frame leg portions including respective first and second side regions, wherein said second side region includes a frame pole face; and a neck portion drawn out from said first leg portion, wherein said first side region includes a partially rounded internal region extending into said neck portion and forming an aperture through said first leg portion.

13. The frame of claim 12 wherein at least one of said first and second frame leg portions include at least one notch, for engaging with a bobbin in said solenoid assembly.

14. A bobbin for use in a solenoid assembly, said bobbin comprising:

first and second bobbin end portions; and a bobbin intermediate portion extending between said first and second bobbin end portions, said bobbin intermediate portion defining a plunger receiving region extending through said first end portion of said bobbin, wherein said second end portion extends across said plunger receiving region of said bobbin intermediate portion, for creating a fixed gap of bobbin material between said plunger receiving region and a solenoid frame when assembled into said solenoid assembly.

15. The bobbin of claim 14, wherein said first and second end portions and said bobbin intermediate portion are formed as one piece from a dielectric material.

16. The bobbin of claim 14 wherein at least one of said first and second end portions includes at least one frame locking member having a ramped surface, for sliding into locking engagement with a locking region on a frame in said solenoid assembly.

17. A bobbin for use in a solenoid assembly, said bobbin comprising:

first and second bobbin end portions;

an bobbin intermediate portion extending between said first and second bobbin end portions, said bobbin intermediate portion defining a plunger receiving region extending through said first end portion of said bobbin; and at least one wire anchor member extending from and one-piece with at least one of said first and second end portions, for anchoring ends of a wire wound on said bobbin intermediate portion.

18. The bobbin of claim 17, wherein said first and second end portions, said at least one wire anchor member, and said bobbin intermediate portion are formed as one piece from a dielectric material.

19. The bobbin of claim 17 wherein at least one of said first and second end portions includes at least one frame locking member having a ramped surface, for sliding into locking engagement with a locking region on a frame in said solenoid assembly.

20. A solenoid comprising:

a frame including first and second side regions, wherein said first side region includes a partially rounded internal region defining an aperture through said first side region, and wherein said second side region defines a frame pole face generally opposite said aperture through said first side region;

a coil assembly received between said first and second side regions of said frame, said coil assembly including a bobbin and a wire wound around said bobbin, and wherein said bobbin defines a plunger receiving region aligned with said aperture through said first side region of said frame; and a plunger slidably received through said aperture of said frame and within said plunger receiving region of said bobbin, said plunger including a plunger pole face generally facing said frame pole face of said second side region of said frame, wherein magnetic flux flows from said partially rounded internal region of said first side region of said frame to said plunger, through said plunger, and from said plunger pole face of said plunger to said frame pole face on said second side region of said frame.

21. The solenoid of claim 20 wherein said frame includes first and second frame leg portions extending from a frame middle portion, wherein said first and second side regions of said frame are formed on respective said first and second frame leg portions, and wherein said first frame leg portion includes a neck portion drawn out from said frame leg portion and forming said partially rounded internal region defining said aperture through said first side region.

22. The solenoid of claim 20 wherein said bobbin includes:

first and second bobbin end portions engaged with respective said first and second side regions of said frame; and a bobbin intermediate portion extending between said first and second bobbin end portions, said bobbin intermediate portion defining said plunger receiving region extending through said first end portion of said bobbin.

23. The solenoid of claim 22 wherein said first and second end portions and said bobbin intermediate portion are formed as one piece from a dielectric material.

24. The solenoid of claim 22 wherein at least one of said first and second side regions of said frame includes at least one notch, and wherein a corresponding one of said first and second bobbin end portions includes at least one frame locking member in locking engagement with said at least one notch.

25. The solenoid of claim 22 wherein said second end portion of said bobbin extends across said plunger receiving region forming a fixed gap between said plunger and said frame pole face on said second side region of said frame.

26. The solenoid of claim 22 wherein said bobbin further includes at least one wire anchor member extending from and one-piece with at least one of said first and second end portions, for anchoring ends of said wire wound on said bobbin intermediate portion.

27. The solenoid of claim 20 wherein said plunger pole face of said plunger has a generally truncated cone shape.

* * * * *